US005996356A

United States Patent [19]

Kishimoto et al.

[11] Patent Number: 5,996,356

[45] Date of Patent: Dec. 7, 1999

[54] PARALLEL TYPE REFRIGERATOR

[75] Inventors: Akio Kishimoto; Kenji Ueda; Kazuhiko Imoto; Zenichi Yoshida, all of Takasago, Japan

[73] Assignee: Mitsubishi Heavy Industries, Ltd., Tokyo, Japan

[21] Appl. No.: 08/956,542

[22] Filed: Oct. 23, 1997

[30] Foreign Application Priority Data

Oct. 24, 1996 [JP] Japan ..... 8-299237

[51] Int. Cl.[6] ..... F25B 5/00; F25B 41/00

[52] U.S. Cl. ..... 62/117; 62/196.4; 62/510; 165/140

[58] Field of Search ..... 62/510, 175, 498, 62/117, 196.4; 165/140

[56] References Cited

U.S. PATENT DOCUMENTS 2,241,060 5/1941 Gibson ..... 62/510 X
2,796,743 6/1957 McFarlan ..... 62/335
3,568,763 3/1971 Stoker ..... 165/162 X

*Primary Examiner*—William Wayner
*Attorney, Agent, or Firm*—Alston & Bird LLP

[57] ABSTRACT

A parallel type refrigerator provided with a plurality of condensing chambers which are formed by partitioning the inside of a shell of a condenser by partition plates so that a cooling medium flows through tubes respectively provided in the plurality of condensing chambers in sequence, and further provided with a plurality of evaporating chambers which are formed by partitioning the inside of a shell of an evaporator by partition plates so that a cooled medium flows through tubes respectively provided in the plurality of evaporating chambers in sequence. Further, in this apparatus, the plurality of condensing chambers of the condenser, the plurality of throttling mechanisms, the plurality of evaporating chambers and the plurality of compressors are connected through refrigerant piping so that refrigerants discharged from the plurality of compressors are circulated to the plurality of compressors through the plurality of condensing chambers of the condenser, the plurality of throttling mechanisms and the plurality of evaporating chambers in this order.

5 Claims, 5 Drawing Sheets

PARALLEL TYPE REFRIGERATOR

FIELD OF THE INVENTION AND RELATED ART STATEMENT

The present invention relates to a parallel type refrigerator and, more particularly, to a parallel type refrigerator provided with a plurality of compressors, a shell-and-tube type condenser, a plurality of throttling mechanisms and a shell-and-tube type evaporator.

Referring to FIG. 6, there is shown an example of such a conventional (namely, related art) parallel type refrigerator.

When operating this refrigerator, two compressors 31 and 32 are driven by electric motors 51 and 52, respectively. Then, gaseous refrigerants respectively discharged from these compressors 31 and 32 enter right-side condensing chambers 35*a* and 35*b*, and are further condensed and liquefied at 39° C. in the condensing chambers 35*a* and 35*b*, which are formed by partitioning the inside of a shell 34 of a shell-and-tube type condenser 33 by means of a partition plate 48, by dissipating heat to cooling media, such as cooling water, which flow through tubes 37*a* and 37*b*, respectively.

High-temperature and high-pressure liquid(-phase) refrigerant, which has been condensed and liquified in this way, is brought into an atomized state by flowing through throttling mechanisms (pressure reducing mechanism) 36*a* and 36*b*, which also serve as flow-rate control devices, and then flows into a shell 46 of a shell-and-tube type evaporator 39. This atomized refrigerant is evaporated and vaporized at 4° C. by cooling cooled media, such as cold water and brine, flowing through tubes 38*a* and 38*b*.

Thus, this gaseous refrigerant is sucked into the condensers 31 and 32 in parallel and is then condensed again therein. Thence, the herein-above-mentioned operation is performed repeatedly.

On the other hand, the cooling medium (namely, the cooling water) flows into an inlet chamber (or header) 40 of the condenser 33 at 32° C. and then flows and passes through the tube 37*a* and in a deflection chamber 41. Subsequently, the cooling medium is turned at a deflection chamber 41. Then, the cooling medium flows out of an outlet chamber (or header) 42 in which the temperature thereof has been raised to 37° C., after flowing through the tube 37*b*.

Further, the cooled medium (namely, the cold water) flows into an inlet chamber 43 of the evaporator 39 at 12° C. Subsequently, the cooled medium flows through the tube 38*a* and is turned in a deflection chamber 44. Then, the cooled medium flows out of an outlet chamber 45 in which the temperature thereof has been lowered to 7° C., after flowing through the tube 38*b*.

Refrigerating cycle of the aforementioned refrigerator is indicated by a solid line in Mollier diagram of FIG. 4.

Gaseous refrigerant put in a state a is sucked into the compressors 31 and 32. Subsequently, the gaseous refrigerant is brought into a state b by being compressed by these compressors 31 and 32, and then enters the condenser 33.

This gaseous refrigerant starts condensing at 39° C. from a state c by being cooled in the condenser 33. Thereafter, this refrigerant is changed into a saturated liquid refrigerant in a state d. This saturated liquid refrigerant is then throttled (reduced) by the throttling mechanisms 36*a* and 36*b*. Thus, the refrigerant is subjected to adiabatic expansion and is put into a state e. Subsequently, this refrigerant enters the evaporator 39 in which the refrigerant evaporates at 4° C. Moreover, the refrigerant is heated therein and is thus put into a state a. Incidentally, in FIG. 4, reference character J denotes a saturated vapor line, and K denotes a saturated liquid line.

Additionally, in the case that a refrigerating load decreases and becomes equal to or lower than 50%, one of the compressors 31 and 32 is stopped so as to save power.

In the case of the aforementioned refrigerator, the evaporation temperature (namely, 4° C.) of the refrigerant is lower than the outlet temperature (namely, 7° C.). Further, the condensation temperature (namely, 39° C.) of the refrigerant is lower than the outlet temperature (namely, 37° C.). Therefore, the aforementioned refrigerator has encountered the problem in that the quantity of work (or the work done) of each of the compressors 31 and 32 is large and that thus the power consumption thereof is large.

OBJECT AND SUMMARY OF THE INVENTION

The present invention is accomplished to solve the aforementioned problems of the aforesaid related art refrigerator.

Accordingly, a first object of the present invention is to provide a parallel type refrigerator which can reduce the quantity of work of a compressor in each refrigerating cycle and can save energy.

Further, a second object of the present invention is to provide a parallel type refrigerator which can make full use of the condensing ability of a plurality of compressors and the evaporating ability of a plurality of evaporators even in the case that one of the compressors is stopped, thereby increasing the coefficient of performance thereof.

To achieve the foregoing first object of the present invention, in accordance with the present invention, there is provided a parallel type refrigerator which comprises a plurality of compressors, a shell-and-tube type condenser, a plurality of throttling mechanisms and a shell-and-tube type evaporator, wherein a plurality of condensing chambers are formed by partitioning the inside of a shell of the aforesaid condenser by partition plates, wherein a cooling medium flows through tubes respectively provided in the plurality of condensing chambers in sequence, wherein a plurality of evaporating chambers are formed by partitioning the inside of a shell of the aforesaid evaporator by partition plates, wherein a cooled medium flows through tubes respectively provided in the plurality of evaporating chambers in sequence, and wherein the plurality of condensing chambers of the aforesaid condenser, the plurality of throttling mechanisms, the plurality of evaporating chambers and the plurality of compressors are connected through refrigerant piping so that refrigerants discharged from the aforesaid plurality of compressors are circulated to the aforesaid plurality of compressors through the plurality of condensing chambers of the aforesaid condenser, the plurality of throttling mechanisms and the plurality of evaporating chambers in this order.

Thus, the quantity of work of the compressors in each refrigerating cycle can be reduced. Consequently, the driving power of each of the compressors can be saved. Therefore, this refrigerator of the present invention can contribute to saved energy.

Further, to attain the foregoing second object of the present invention, in the case of an embodiment of the refrigerator of the present invention, the plurality of condensing chambers are connected with one another through bypass pipes in each of which an opening/closing valve is inserted, and wherein the plurality of evaporators are connected with one another through bypass pipes in each of which an opening/closing valve is inserted.

Thus, in the case that one of the compressors is stopped, the refrigerator can make full use of the condensing ability of the condensing chambers and the evaporating ability of the evaporating chambers by opening each of the opening/closing valves. Consequently, the coefficient of performance of the refrigerator can be enhanced.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF PREFERRED EMBODIMENTS

Figure 1:
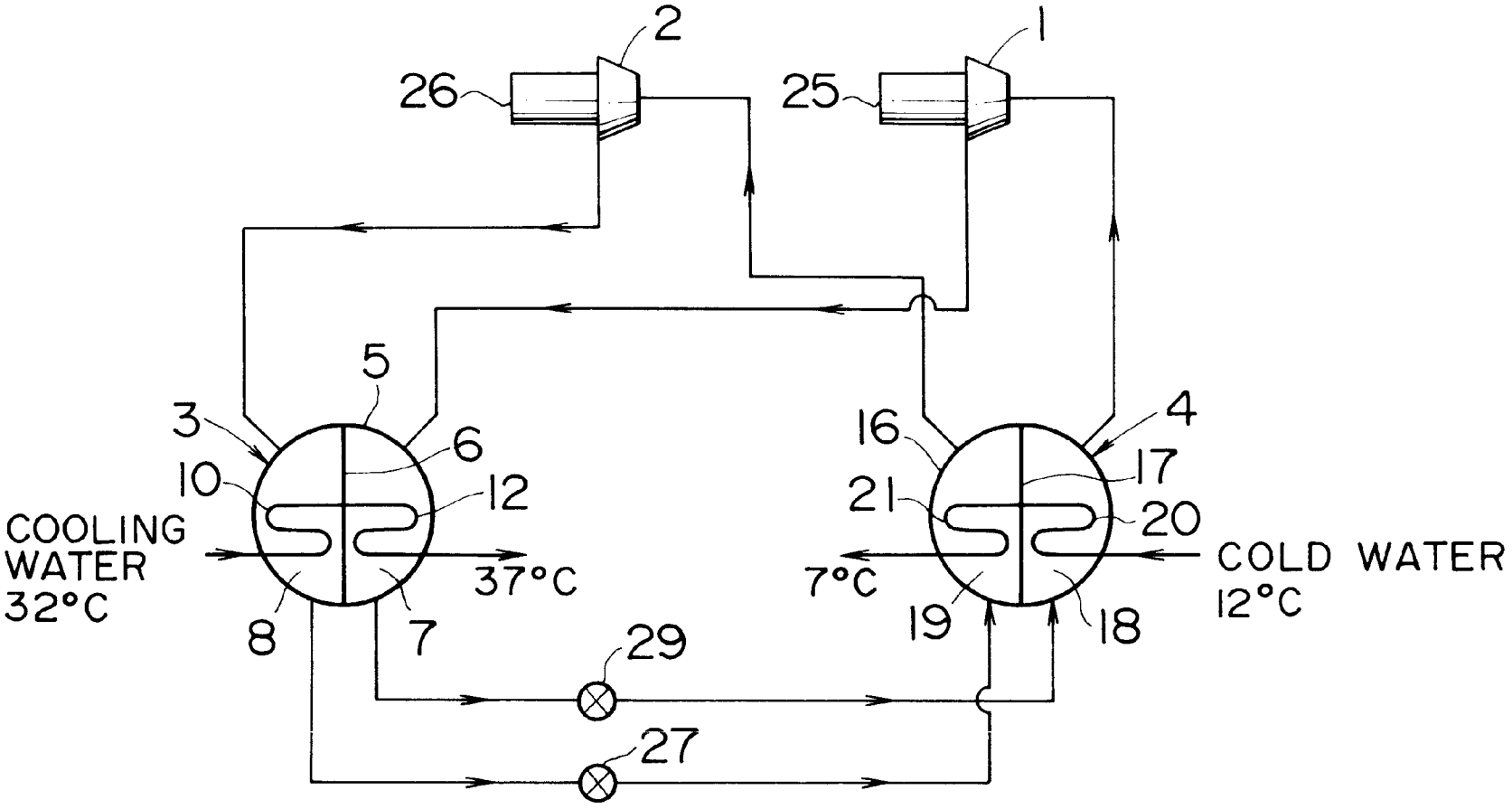
FIG. 1 is a system diagram illustrating a parallel type refrigerator which is a first embodiment of the present invention.

FIG. 1 shows a first embodiment of the present invention.

In FIG. 1, reference numerals 1 and 2 designate compressors; 3 a shell-and-tube type condenser; 4 a shell-and-tube type evaporator; and 27 and 29 throttling mechanisms.

Condenser 3 is provided with two condensing chambers 7 and 8 which are formed by partitioning the inside of a shell 5 thereof by use of a partition plate 6. Cooling medium such as cooling water flows into a tube 10, which is provided in the condensing chamber 8, when the temperature of the cooling medium is 32° C. Further, the cooling medium flows through this tube 10 and a tube 12 provided in the condensing chamber 7 in this order. As a result, the temperature of the cooling medium is raised to 37° C. Then, the cooling medium flows out of the condenser 3.

Similarly, the evaporator 4 is provided with two evaporating chambers 18 and 19 which are formed by partitioning the inside of a shell 16 thereof by means of a partition plate 17. Cooled medium such as cold water or brine flows into a tube 20, which is provided in the evaporator 18, when the temperature of the cooled medium is 12° C. Subsequently, this cooled medium flows through this tube 20 and a tube 21 provided in the evaporator 19 in this order. As a consequence, the temperature of the cooling medium is lowered to 7° C. Then, the cooling medium flows out of the evaporator 4.

Figure 2:
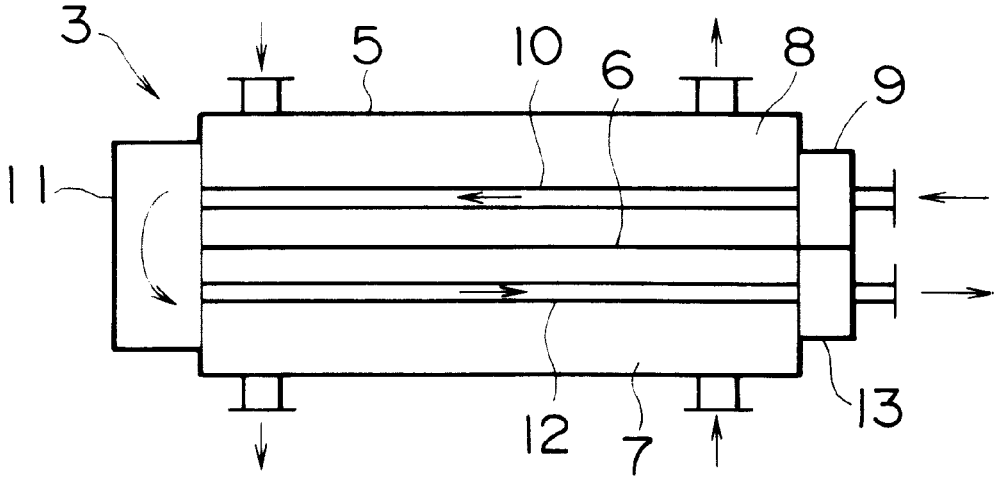
FIG. 2 is a diagram showing the configuration of a condenser used in the parallel type refrigerator which is the first embodiment of the present invention.

As illustrated in FIG. 2, in the case that the shell 5 is partitioned into upper and lower chambers by using the partition plate 6 provided in parallel with the tubes 10 and 12, a cooling medium flows through the inside of the tube 10, which is provided in the condenser 8, from an inlet chamber (or header) 9. Then, the cooling medium is turned in a deflecting chamber 11. Thereafter, the cooling medium flows out of an outlet chamber (or header) 13 through the tube 12 which is provided in the condensing chamber 7.

Figure 3:
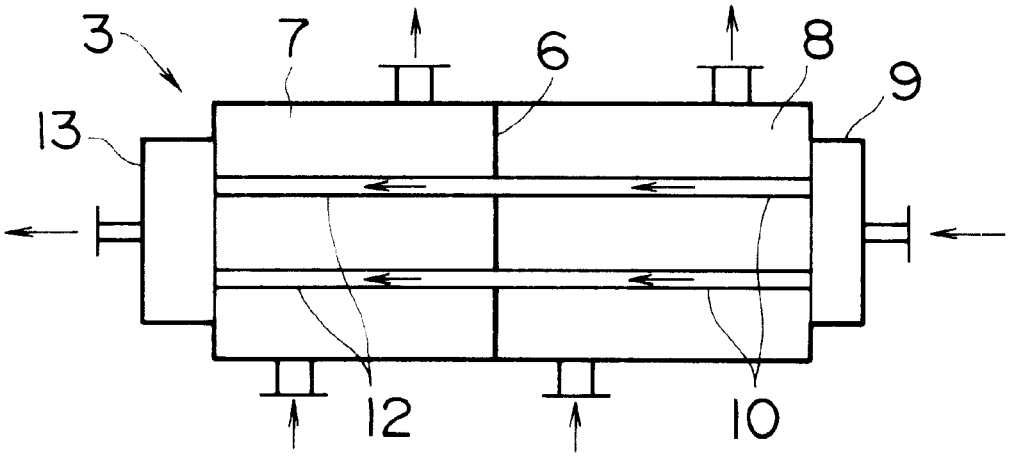
FIG. 3 is a diagram showing the configuration of another type condenser used in the parallel type refrigerator which is different from the condenser of FIG. 2.

Further, in the case that the shell 5 is partitioned into two chambers, namely, left-side and right-side chambers by a partition plate 6 provided in parallel with the tubes 10 and 12, as illustrated in FIG. 3, the refrigerant flows into the inlet chamber 9 and thereafter streams out of the outlet chamber 13 through the tube 10, which is provided in the condensing chamber 8, and the tube 12 provided in the condensing chamber 7.

Incidentally, the evaporator 4 is configured similarly as the herein-above-mentioned condenser 3 is constructed.

In the case where the refrigerating load is high, the compressors 1 and 2 are driven by the electric motors 25 and 26, respectively.

Then, a gaseous refrigerant discharged from the compressor 1 enters the condensing chamber 7 of the condenser 3. In this chamber, the gaseous refrigerant is condensed and liquefied in an atmosphere at 39° C. by dissipating heat to the cooling medium flowing through the tube 12.

The flow rate of this liquid refrigerant is regulated by throttling thereof by means of the throttling mechanism 29. Simultaneously with this, the refrigerant is subjected to adiabatic expansion and then enters the evaporating chamber 18 of the evaporator 4, in which the refrigerant evaporates and vaporizes at 6.5° C. by cooling the cooled medium flowing through the tube 20. Thereafter, the refrigerant is sucked into the compressor 1.

On the other hand, a gaseous refrigerant discharged from the compressor 2 enters the condensing chamber 8 of the condenser 3, in which the gaseous refrigerant is condensed and liquefied at 36.5° C. by dissipating heat to the cooling medium flowing through the tube 10.

The flow rate of this liquid refrigerant is regulated by throttling thereof by means of the throttling mechanism 27. Concurrently with this, the refrigerant is subjected to adiabatic expansion and then enters the evaporating chamber 19 of the evaporator 4, in which the refrigerant evaporates and vaporizes at 4° C. by cooling the cooled medium flowing through the tube 21. Thereafter, the refrigerant is sucked in to the compressor 2.

Incidentally, in the case that the refrigerating load decreases and becomes equal to or lower than 50%, one of the compressors 1 and 2 is stopped so as to save power.

For example, in the case that the compressor 2 stops and the compressor 1 is operated, a refrigerant discharged from the compressor 1 flows through the condensing chamber 7 of the condenser 3, the throttling mechanism 29 and the evaporating chamber 18 of the evaporator 4 in this order and then returns to the compressor 1.

Thus, when the compressors 1 and 2 are simultaneously operated, if the inlet and outlet temperatures of the cooling medium are 32° C. and 37° C., respectively; and the inlet and outlet temperatures of the cooled medium are 12° C. and 7° C., respectively, similarly as in the related art case, the condensation temperature of the condensing chamber 7 is 39° C.; the condensation temperature of the condensing chamber 8 is 36.5° C.; the evaporation temperature of the evaporating chamber 18 is 6.5° C.; and the evaporation temperature of the evaporating chamber 19 is 4° C.

Figure 4:
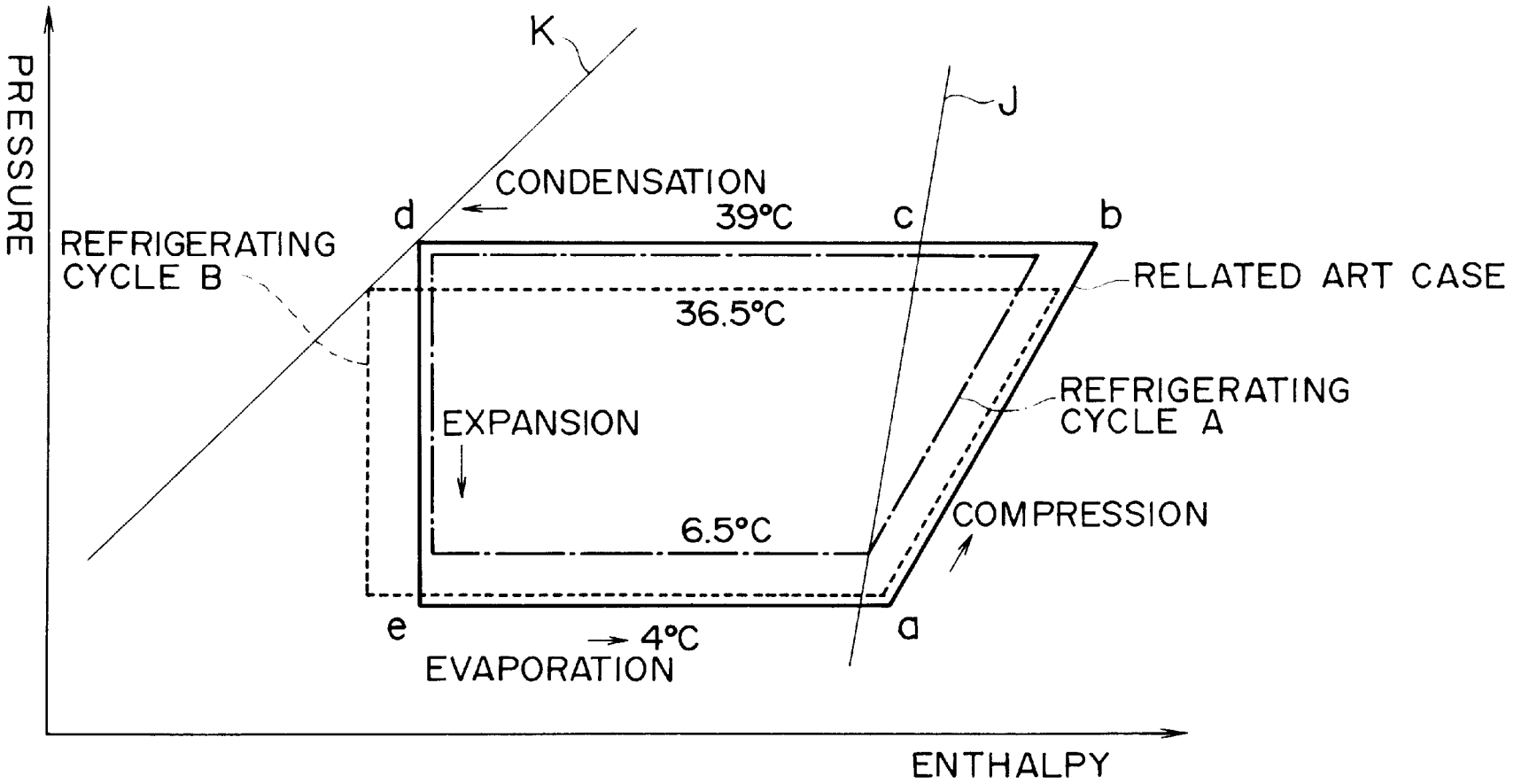
FIG. 4 is Mollier diagram in the case of the first embodiment of the present invention.

Therefore, the refrigerating cycle A consisting of the compressor 1, the condensing chamber 7, the throttling mechanism 29 and the evaporating chamber 18 is indicated by one-dot chain lines in Mollier diagram of FIG. 4. As compared with the refrigerating cycle (indicated by solid lines) of the related art case, the quantity of work of the compressor 1 is reduced by a quantity corresponding to the rise of the evaporation temperature from 4° C. to 6.5° C.

Further, the refrigerating cycle B consisting of the compressor 2, the condensing chamber 8, the throttling mechanism 27 and the evaporating chamber 19 is indicated by dashed lines in Mollier diagram of FIG. 4. As compared with the refrigerating cycle (indicated by solid lines) of the related art case, the quantity of work of the compressor 2 is reduced by a quantity corresponding to the drop of the evaporation temperature from 39° C. to 36.5° C.

Figure 5:
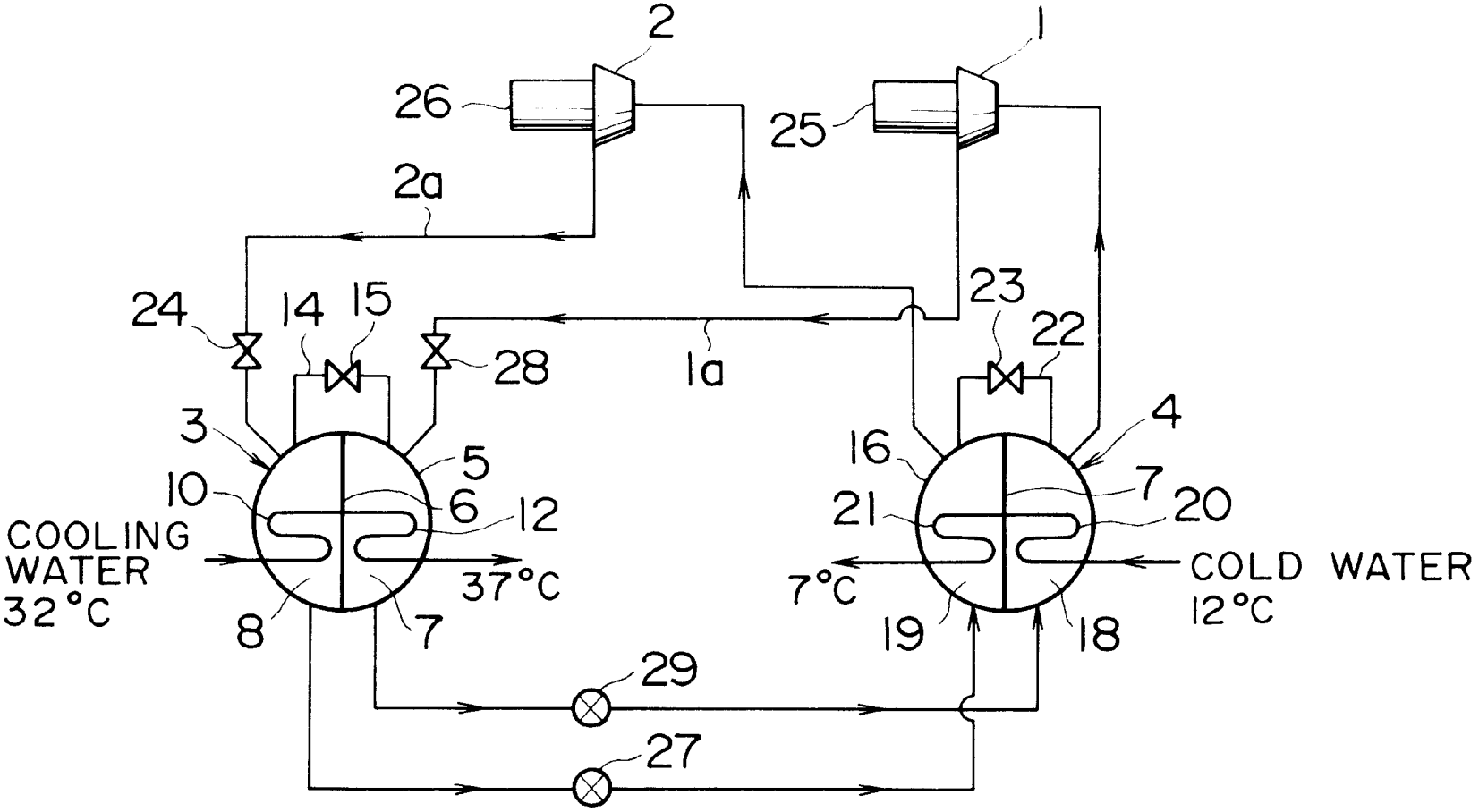
FIG. 5 is a system diagram illustrating another parallel type refrigerator which is a second embodiment of the present invention.
Figure 6:
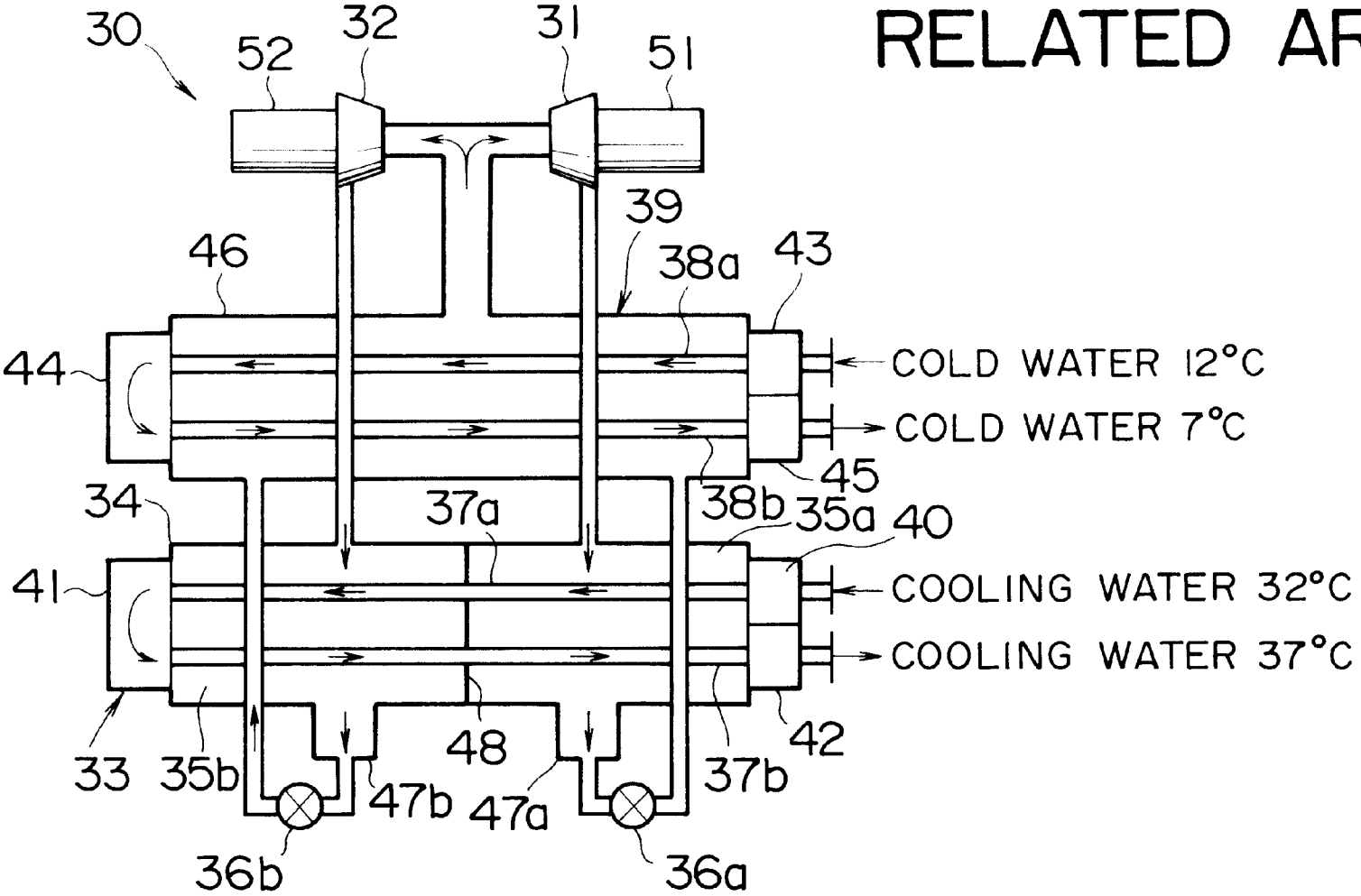
FIG. 6 RELATED ART
FIG. 6 is a diagram schematically illustrating a related art parallel type refrigerator.

FIG. 5 shows a second embodiment of the present invention.

In the case of this second embodiment of the present invention, condensing chambers 7 and 8 of a condenser 3 are connected with each other through a bypass pipe 14 into which an opening/closing valve 15 is inserted.

Further, evaporating chambers 18 and 19 of an evaporator 4 are connected with each other through a bypass pipe 22 into which an opening/closing valve 23 is inserted.

Moreover, an opening/closing valve 28 is inserted into a discharge pipe 1*a* of the compressor 1, while an opening/closing valve 24 is inserted into a discharge pipe 2*a* of a compressor 2.

Incidentally, these opening/closing valves 28 and 24 may be replaced with check valves, respectively.

The remaining composing elements of the second embodiment are similar to the corresponding composing elements of the first embodiment illustrated in FIG. 1. Thus, like reference characters designate the corresponding members of the first embodiment. Moreover, the description of such composing elements is omitted.

Thus, in the case that the compressors 1 and 2 are simultaneously operated, both of the opening/closing valves 15 and 23 are closed. In contrast, both of the opening/closing valves 24 and 28 are opened.

Then, refrigerants discharged from the compressors 1 and 2 are circulated to the compressors 1 and 2 through the opening/closing valves 28 and 24, the condensing chambers 7 and 8 of the condenser 5, the throttling mechanisms 29 and 27 and the evaporating chambers 18 and 19 of the evaporator 4 in this order, respectively.

In the case that one of the compressors 1 and 2 is stopped, for instance, the compressor 2 is stopped and only the compressor 1 is operated, the opening/closing valve 24 is closed but both of the opening/closing valves 15 and 23 are opened.

Thus, a gaseous refrigerant discharged from the compressor 1 enters the condensing chamber 7 of the condenser 3 through the opening/closing valve 28. In this chamber 7, a part of the gaseous refrigerant is condensed and liquefied by dissipating heat to the cooling medium flowing through the tube 12. Simultaneously with this, the rest of the gaseous refrigerant enters the condensing chamber 8 through the opening/closing valve 15. In this chamber 8, this gaseous refrigerant is condensed and liquefied by dissipating heat to the cooling medium flowing through the tube 10.

Liquid refrigerant obtained by being condensed in the condensing chamber 8 enters the evaporating chamber 19 of the evaporator 4 through the throttling mechanism 27. In this chamber, the liquid refrigerant evaporates by cooling a cooled medium flowing through the tube 21. Thereafter, this refrigerant enters the evaporating chamber 18 through the bypass pipe 22 and the opening/closing valve 23.

On the other hand, the liquid refrigerant, which is obtained by being condensed in the condensing chamber 7, enters the evaporating chamber 18 of the evaporator 4 through the throttling mechanism 29. In this chamber, this refrigerant evaporates by cooling a cooled medium flowing through the tube 20. Thereafter, this refrigerant joins the gaseous refrigerant, which flows thereinto through the bypass pipe 22, and these refrigerants are sucked into the compressor 1.

Thus, even in the case that one of the compressors 1 and 2 is stopped, the apparatus can make full use of the condensing ability of the condensing chambers 7 and 8 and the evaporating ability of the evaporating chambers 18 and 19. Therefore, the condensation temperature of the second embodiment can be made to be lower than that of the first embodiment illustrated in FIG. 1. In addition, the evaporation temperature of the second embodiment can be made to be higher than that of the first embodiment. Consequently, the quantity of work of the compressor 1 or 2 can be reduced.

Although preferred embodiments of the present invention have been described above, it should be understood that the present invention is not limited thereto and that other modifications will be apparent to those skilled in the art without departing from the spirit of the invention.

The scope of the present invention, therefore, should be determined solely by the appended claims.

What is claimed is:

1. A parallel-type refrigerator, comprising:

at least two compressors;

a shell-and-tube condenser including a shell partitioned by a partition into a high-temperature condensing chamber and a low-temperature condensing chamber, and a cooling tube passing first through said low-temperature condensing chamber and then through said high-temperature condensing chamber in sequence and carrying a cooling medium, each condensing chamber having an inlet for receiving refrigerant from one of the compressors and an outlet for discharging refrigerant;

at least two throttling mechanisms respectively connected to the outlets of said condensing chambers; and a shell-and-tube evaporator including a shell partitioned by a partition into a high-temperature evaporating chamber and a low-temperature evaporating chamber, and a cooled tube passing first through said high-temperature evaporating chamber and then through said low-temperature evaporating chamber in sequence and carrying a cooled medium;

said compressors, condenser, throttling mechanisms, and evaporator being connected such that at least two refrigerant circuits are formed, refrigerant in one circuit flowing from one of said compressors, through said high-temperature condensing chamber, through one of said throttling mechanisms, through said high-temperature evaporating chamber, and back to said one compressor, and refrigerant in another circuit flowing from the other compressor, through said low-temperature condensing chamber, through the other throttling mechanism, through said low-temperature evaporating chamber, and back to the other compressor.

2. The parallel-type refrigerator of claim 1, wherein said condensing chambers are connected to each other via bypass valves, and said evaporating chambers are connected to each other via bypass valves, such that when the compressor in one of said refrigerant circuits is deactivated, the bypass valves connected to said condensing chamber and evaporating chamber in the deactivated refrigerant circuit are opened to allow refrigerant from the other of said refrigerant circuits to flow through said condensing and evaporating chambers of said deactivated refrigerant circuit.

3. The parallel-type refrigerator of claim 2, further comprising non-return valves coupled between each of said compressors and the respective condensing chamber connected thereto, said non-return valves preventing back-flow to a deactivated compressor when said bypass valves connected to the deactivated refrigerant circuit are open.

4. A method of refrigeration in a parallel-type refrigerator, comprising:

circulating refrigerant through a first refrigerant circuit including a first compressor, a first condensing chamber, a first throttling mechanism, and a first evaporating chamber;

circulating refrigerant through a second refrigerant circuit including a second compressor, a second condensing chamber, a second throttling mechanism, and a second evaporating chamber;

passing a cooling medium sequentially through said second condensing chamber and then through said first condensing chamber, such that said first condensing chamber is at a relatively higher temperature than said second condensing chamber; and passing a cooled medium sequentially through said first evaporating chamber and then through said second evaporating chamber, such that said first evaporating chamber is at a relatively higher temperature than said second evaporating chamber.

5. The method of claim 4, further comprising the steps of:

deactivating said first compressor when the work required from the parallel-type refrigerator falls below a predetermined level;

circulating refrigerant in said second refrigerant circuit through both of said condensing chambers by opening a bypass valve connecting said condensing chambers; and circulating refrigerant in said second refrigerant circuit through both of said evaporating chambers by opening a bypass valve connecting said evaporating chambers.

* * * * *